US006336385B1

(12) United States Patent
Wang

(10) Patent No.: US 6,336,385 B1
(45) Date of Patent: Jan. 8, 2002

(54) BICYCLE TOOL SET

(76) Inventor: Lo-Pin Wang, 16F-2, No. 17, Lane 52, Sec. 3, Re He Rd., Taichung (TW)

( * ) Notice: Subject to any disclaimer, the term of this patent is extended or adjusted under 35 U.S.C. 154(b) by 0 days.

(21) Appl. No.: 09/631,672

(22) Filed: Aug. 3, 2000

(51) Int. Cl.[7] ..... B25B 23/16

(52) U.S. Cl. ..... 81/177.4; 81/180.1; 81/490; 81/437

(58) Field of Search ..... 81/437–439, 440, 81/185.2, 184, 180.1, 490, 177.4; 206/234, 376–378; 7/138, 167, 166, 170

(56) References Cited

U.S. PATENT DOCUMENTS 4,269,311 A * 5/1981 Rich ..... 81/177.4
5,588,169 A * 12/1996 Chuang ..... 81/177.2
5,896,606 A * 4/1999 Huang ..... 81/177.4
6,044,508 A 4/2000 Chuang .....

* cited by examiner

*Primary Examiner*—D. S. Meislin
(74) *Attorney, Agent, or Firm*—Browdy and Neimark

(57) ABSTRACT

A bicycle tool set comprises a first tool member, a second tool member, and a case for housing the first tool member and the second tool member. The first tool member is provided with a tenon, whereas the second tool member is provided with a mortise. The first and the second tool members are detachably held together by the tenon which is rotatably received in the mortise. As the tenon is turned an angle, the two tool members are held securely. The second tool member can be used as wrenches of various forms. The case is provided with a seat for locating the bicycle tool set on a bicycle. The second tool member is also capable of holding a variety of hand tools.

13 Claims, 5 Drawing Sheets

BICYCLE TOOL SET

FIELD OF THE INVENTION

The present invention relates generally to a bicycle accessory, and more particularly to a bicycle tool set for fixing the bicycle.

BACKGROUND OF THE INVENTION

The U.S. Pat. No. 6,044,508 discloses a bicycle tool set comprising a first tool member and a second tool member, which are detachably fastened together. The second tool member is provided with three positioning grooves for retaining some hand tools, such as hexagonal wrenches. The first and the second tool members are held together by a protrusion and a recess in which the protrusion is received. The protrusion is not securely received in the recess, thereby making the first tool member and the second tool member susceptible to separation from each other inadvertently.

SUMMARY OF THE INVENTION

The primary objective of the present invention is to provide a bicycle tool set with a means to hold together securely the tool members of the bicycle tool set.

In keeping with the principle of the present invention, the foregoing objective of the present invention is attained by the bicycle tool set comprising a first tool member and a second tool member. The two tool members are securely held together by a tenon and a mortise such that the two tool members are rotated an angle to locate securely. The second tool member is provided with a plurality of fixation holes for fixing a plurality of hand tools.

The features and the advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
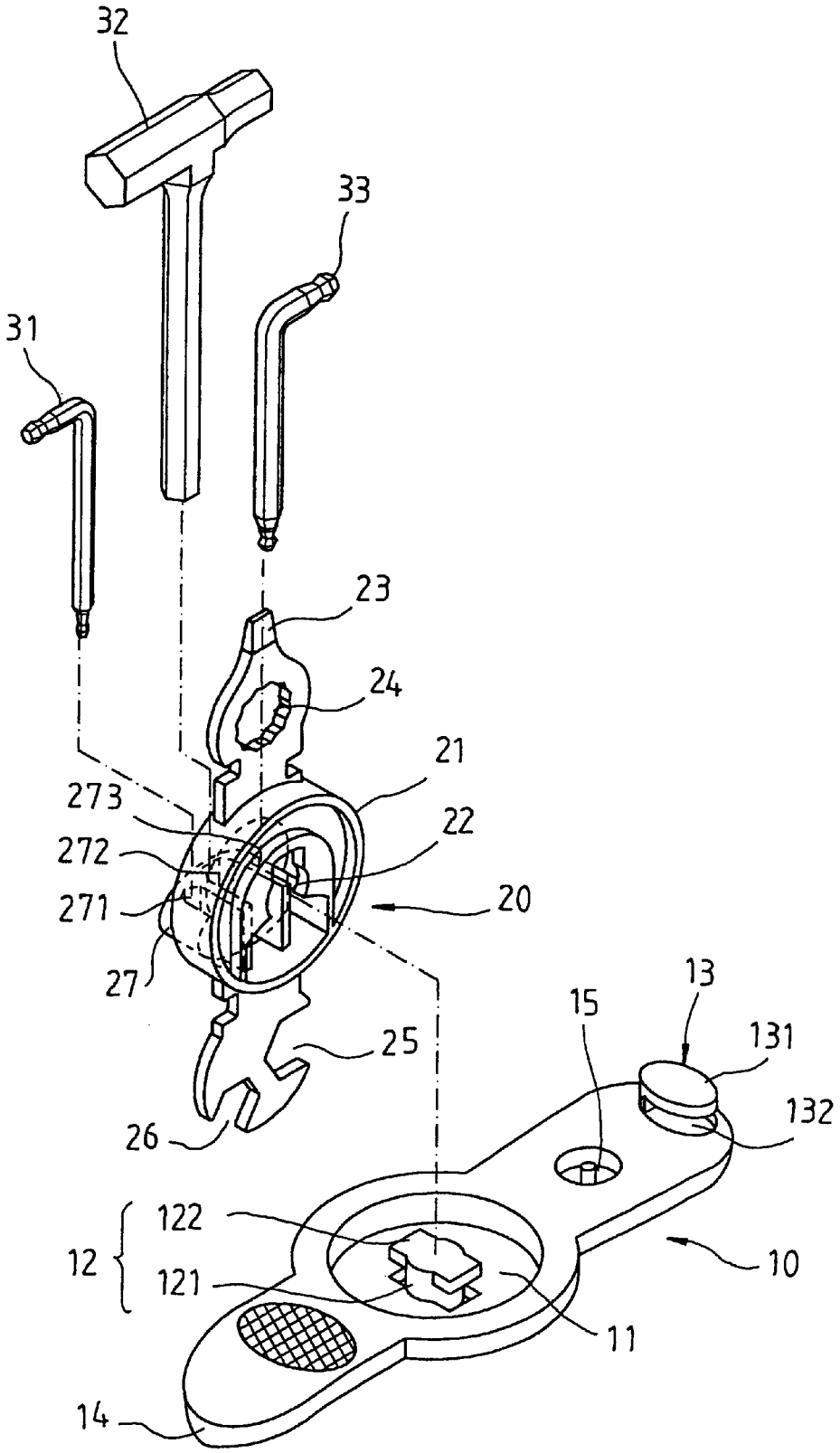
FIG. 1 shows an exploded view of the preferred embodiment of the present invention.

As shown in FIG. 1, a bicycle tool set embodied in the present invention comprises a first tool member 10 and a second tool member 20.

The first tool member 10 is of a long platelike construction and is provided in the midsegment with a pivoting slot 11 which is provided in the bottom wall with a tenon 12. The tenon 12 is provided with a pillar 121 having a round cross section, and with a retaining portion 122 of a long platelike construction. The retaining portion 122 is located at the outer end of the pillar 121 such that the longitudinal axis of the retaining portion 122 is perpendicular to the longitudinal axis of the first tool member 10. The first tool member 10 is further provided in one side with a locating member 13 which is in turn provided with a retaining portion 131 and a recess 132. The first tool member 10 is still further provided at one end with a tire removing end 14 and a tire deflating device 15.

Figure 7:
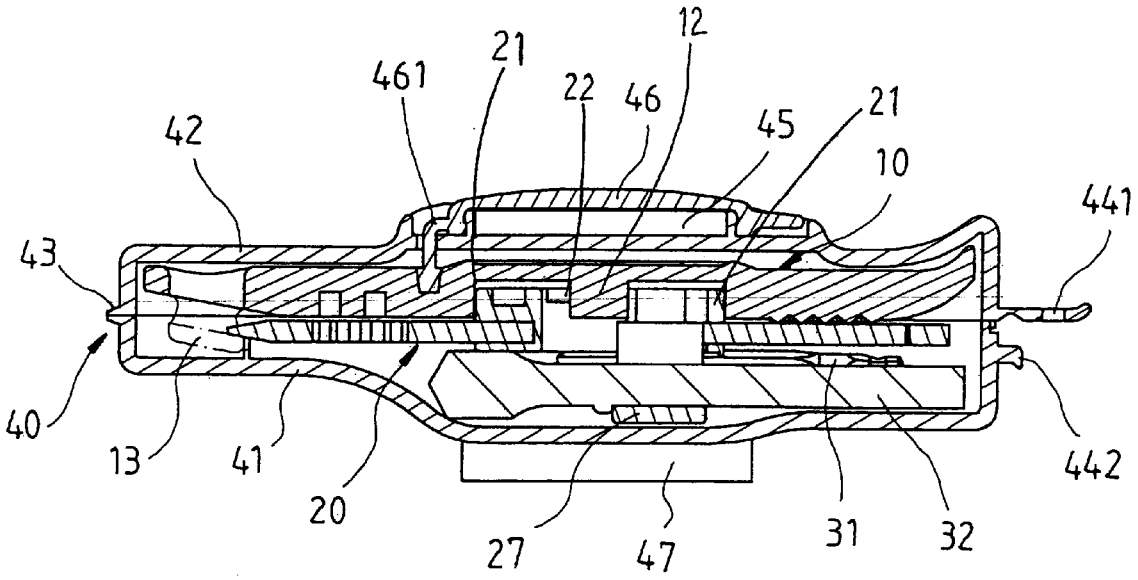
FIG. 7 shows a sectional view taken along the direction indicated by a line 7—7 as shown in FIG. 6.

The second tool member 20 is of a long platelike construction and is provided with a pivoting projection 21 corresponding to the pivoting slot 11 of the first tool member 10. The pivoting projection 21 is provided with a mortise opening 22 corresponding in shape and location to the retaining portion 122 of tenon 12 of the first tool member 10. The length of tenon 12 is greater than the depth of the mortise opening 22, so as to permit retaining portion 122 to engage the second tool member 20 below walls of mortise opening 22 as shown in FIG. 7. The longitudinal direction of the cross section of the mortise opening 22 is parallel to the longitudinal direction of the second tool member 20. The second tool member 20 has a planiform end 23 serving as a screwdriver. The second tool member 20 is provided in one side thereof with a polygonal hole 24, and at the end edge of other side thereof with two polygonal notches 25 and 26. The second tool member 20 can thus be used as a wrench. The pivoting projection 21 is provided with a protruded portion 27 which is in turn provided with three locating holes 271, 272, and 273, for locating three hexagonal wrenches 31, 32, and 33 of various specifications.

Figure 2:
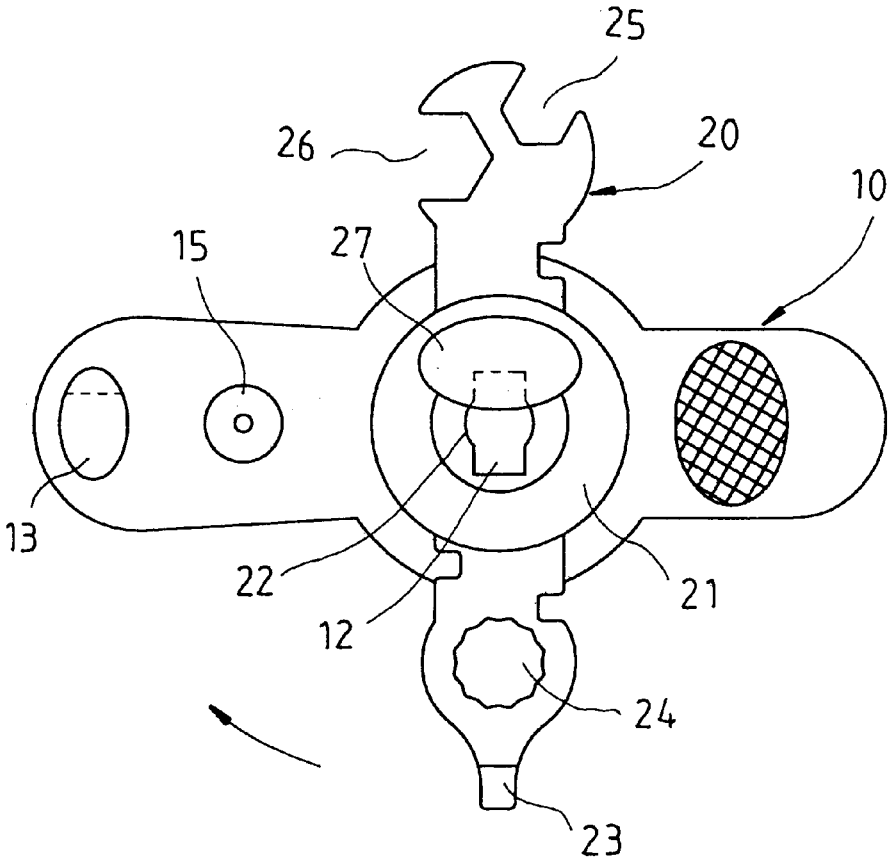
FIG. 2 shows a schematic view of the preferred embodiment of the present invention in combination.
Figure 3:
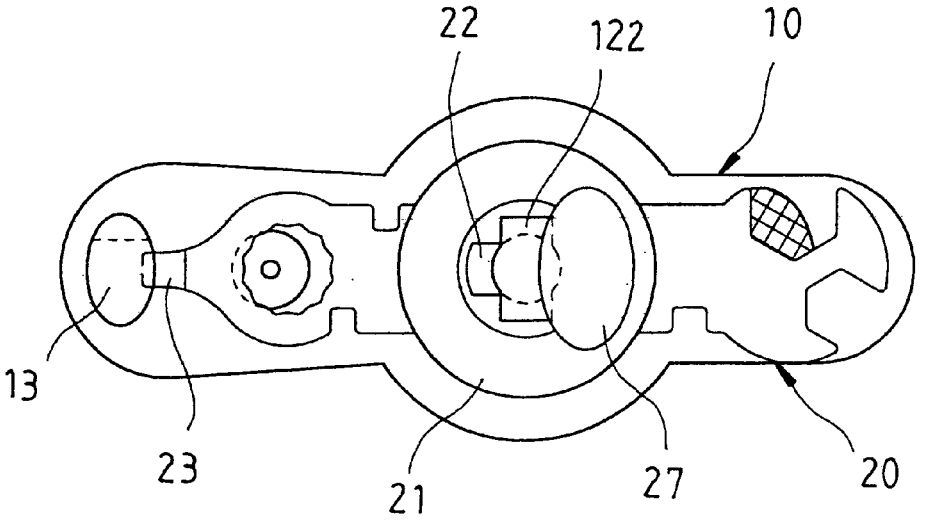
FIG. 3 shows another schematic view of the preferred embodiment of the present invention in combination.
Figure 4:
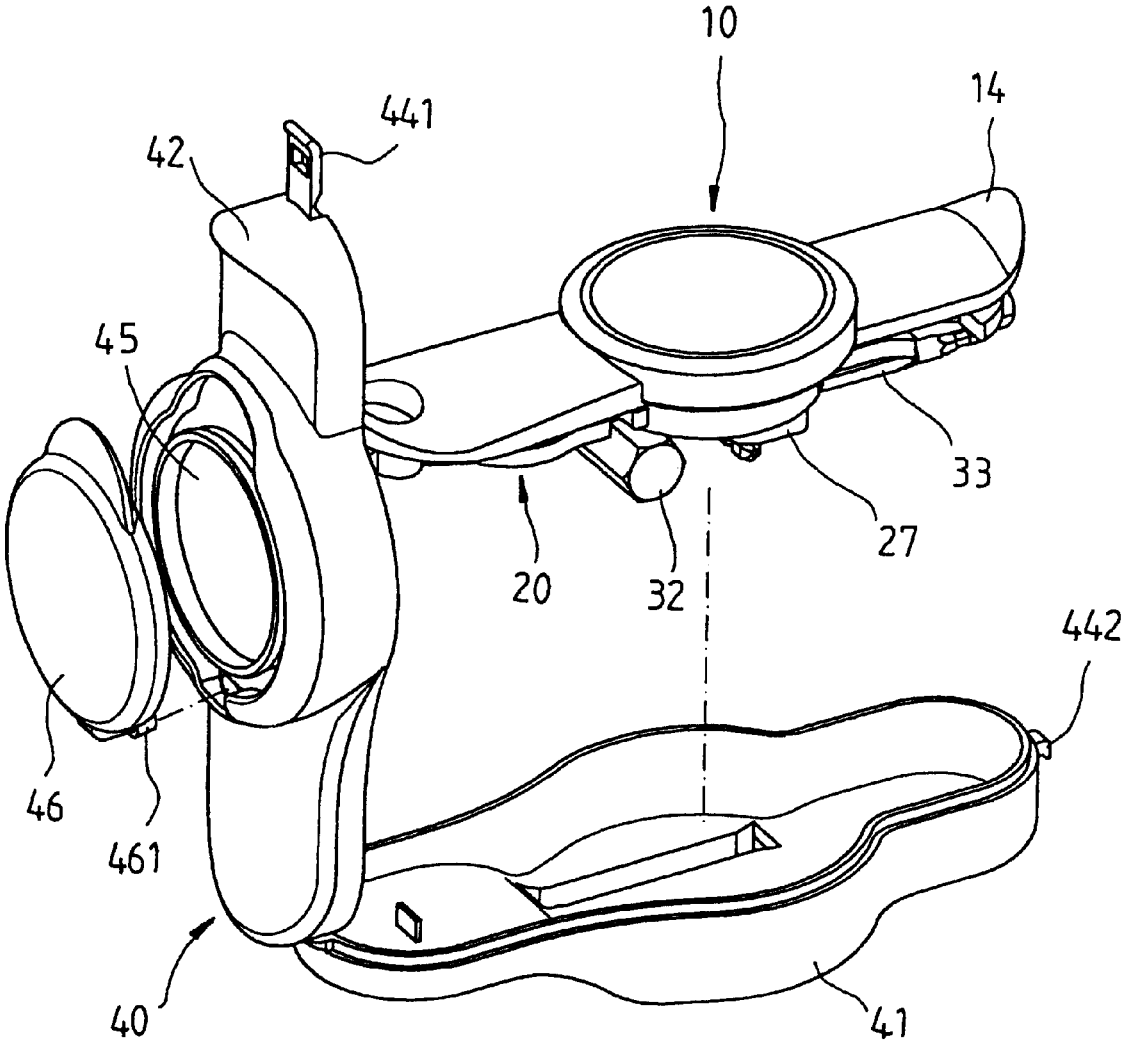
FIG. 4 shows a perspective view of an opened case of the present invention.
Figure 5:
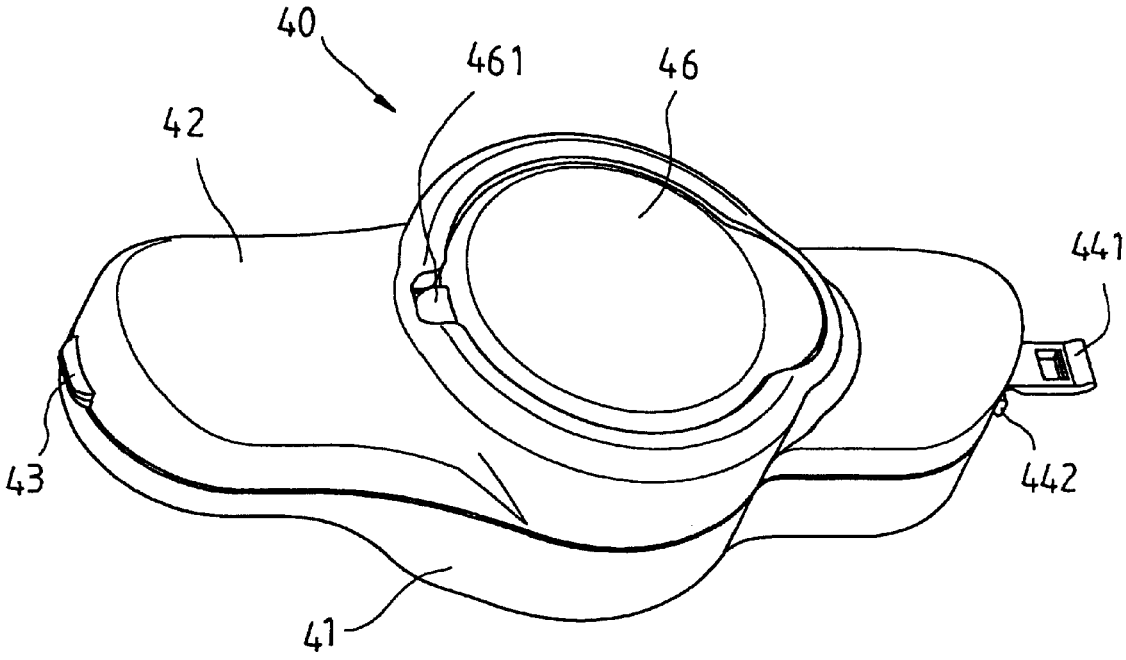
FIG. 5 shows a perspective view of the closed case of the present invention.
Figure 6:
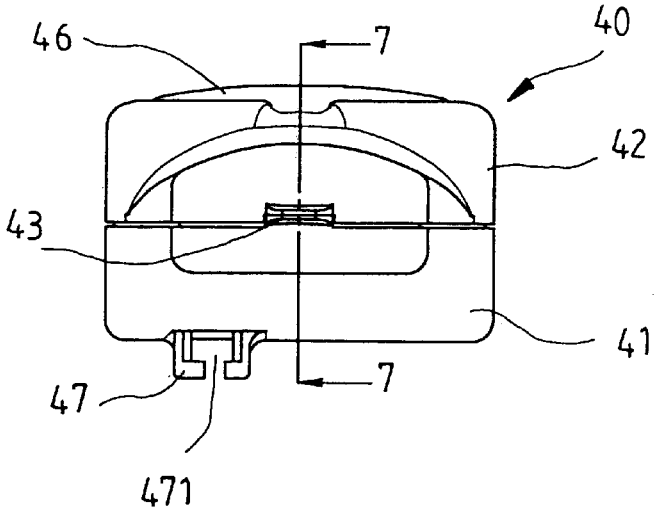
FIG. 6 shows a side view of the case of the present invention.

As shown in FIGS. 2 and 3, the first tool member 10 and the second tool member 20 are held together in a cruciform manner that the tenon 12 of the first tool member 10 is rotatably received in the mortise 22 of the second tool member 20. As the second tool member 20 is turned clockwise for an angle of 90 degrees in relation to the first tool member 10, the planiform end 23 of the second tool member 20 is received in the recess 132 of the locating member 13 of the first tool member 10 such that the planiform end 23 of the second tool member 20 is retained by the retaining portion 131 of the locating member 13 and retaining portion 122 is engaged to second tool member 20 below the side walls of mortise opening 22. As a result, the first tool member 10 and the second tool member 20 are so securely held together that they do not fall apart easily.

As shown in FIGS. 4–7, the bicycle tool set of the present invention further comprises a case 40 for containing the bicycle tool set. The case 40 is made of a plastic material and is formed of a housing 41 and a cover 42. The cover 42 is hinged at one end with the housing 41 by a joint 43 on which the cover 42 can swing and keep the cover 42 with the housing 41. The cover 42 is provided at other longitudinal end with a retaining piece 441, which can be caught by a retainer 442 of the housing 41 to be buckled up. The cover 42 is provided in the top surface with a chamber 45 and a lid 46. The chamber 45 is for keeping the tire repairing pieces (not shown in the drawings) and the lid 46 is for sealing the chamber 45. The lid 46 is provided at one end with a connection piece 461 which is connected with the cover 42 so as to keep the lid 46 with the cover 42 when the lid 46 is opened. The housing 41 is provided in the underside with a locating seat 47 having a locating slot 471 for locating the bicycle tool set of the present invention on a bicycle.

What is claimed is:

1. A bicycle tool set comprising a first tool member, a second tool member and a case for containing said first and said second tool members; one of said first and said second tool members provided with a tenon and the other provided with a mortise, whereby said second tool member detachably fastened with said first tool member such that said tenon is rotatably received in said mortise; said second tool member further provided with a plurality of locating holes for holding securely a plurality of tools; said case further provided with a chamber and a lid detachably covering said chamber whereby said chamber is used to store tire repairing pieces.

2. The bicycle tool set as defined in claim 1, wherein one of said first and said second tool members is provided with a pivoting slot, the other being provided with a pivoting projection, wherein said tenon is located in a bottom of said pivoting slot, said mortise being located on said pivoting projection whereby said first tool member and said second tool member are joined together such that said pivoting projection is rotatably received in said pivoting slot.

3. The bicycle tool set as defined in claim 1, wherein said first tool member is provided with a locating member for locating said second tool member after said second tool member is turned a predetermined angle.

4. The bicycle tool set as defined in claim 1, wherein said second tool member is provided with at least one polygonal hole enabling said second tool member to work as a wrench.

5. The bicycle tool set as defined in claim 1, wherein said second tool member is provided at one end with at least one polygonal notch enabling said second tool member to work as a wrench.

6. The bicycle tool set as defined in claim 1, wherein said case is formed a housing and a cover whereby said cover is hinged at one end with said housing and is provided at other end with a retaining piece capable of being caught by a retainer of said housing.

7. The bicycle tool set as defined in claim 6, wherein said chamber is located in said cover; wherein said lid is provided with a connection piece which is connected with said cover.

8. The bicycle tool set as defined in claim 1, wherein said case is provided in the underside thereof with a locating seat for locating the bicycle tool set on a bicycle.

9. A bicycle tool set comprising:

a first tool member having a tenon; and a second tool member having a mortise;

the tenon having a retaining projection on a free end thereof;

wherein the longitudinal axis of the retaining projection is perpendicular to the longitudinal axis of the first tool;

the mortise having an opening corresponding in a shape to that of the retaining projection;

wherein the longitudinal axis of the mortise opening is parallel to the longitudinal axis of the first tool, and a length of the tenon is greater than a depth of the mortise opening to permit the retaining projection to extend under side walls of the mortise opening;

wherein when the retaining projection is inserted through the mortise opening and the second tool member turned an angle of 90° in relation to the first tool member, the retaining projection is engaged to the second tool member below the side walls of the mortise opening.

10. The bicycle tool set as defined in claim 9, wherein the second tool member has a screwdriver at an end thereof and the first tool member has a retaining portion with a recess at an end thereof;

wherein when the second tool member is turned the angle of 90° the screwdriver is retained in the recess of the retaining portion.

11. The bicycle tool set as defined in claim 9, wherein one of said first and second tool members is provided with a pivoting slot, the other being provided with a pivoting projection, wherein said tenon is located in a bottom of said pivoting slot, said mortise being located on said pivoting projection, wherein when said first tool member and said second tool member are joined together the pivoting projection is rotatably received in the pivoting slot.

12. The bicycle tool set as defined in claim 9, wherein said second tool member is provided with at least one polygonal hole enabling said second tool member to work as a wrench.

13. The bicycle tool set as defined in claim 9, wherein said second tool member is provided at one end with at least one polygonal notch enabling said second tool member to work as a wrench.

* * * * *